US006892410B2

(12) United States Patent
Tokuno et al.

(10) Patent No.: US 6,892,410 B2
(45) Date of Patent: May 17, 2005

(54) REINFORCEMENT STRUCTURE OF TRUSS BRIDGE OR ARCH BRIDGE

(75) Inventors: Mitsuhiro Tokuno, Ishikawa-ken (JP); Fumihiro Saito, Ishikawa-ken (JP); Seio Takeshima, Aichi-ken (JP); Yoshiaki Nakai, Ishikawa-ken (JP)

(73) Assignee: Asahi Engineering Co., Ltd., Ishikawa-ken (JP)

( * ) Notice: Subject to any disclaimer, the term of this patent is extended or adjusted under 35 U.S.C. 154(b) by 0 days.

(21) Appl. No.: 10/653,173

(22) Filed: Sep. 3, 2003

(65) Prior Publication Data

US 2004/0040100 A1 Mar. 4, 2004

(30) Foreign Application Priority Data

Sep. 4, 2002 (JP) ..... 2002-258898

(51) Int. Cl.[7] ..... E01D 19/00
(52) U.S. Cl. ..... 14/14; 14/13; 14/25; 52/223.8
(58) Field of Search ..... 14/3, 4, 5, 9, 10, 14/13, 14, 24, 25, 26; 52/223.8

(56) References Cited

U.S. PATENT DOCUMENTS

| | | | | | |
|---|---|---|---|---|---|
| 29,825 | A | * | 8/1860 | Roebling | 14/3 |
| 47,920 | A | * | 5/1865 | Boles, Jr. | 14/4 |
| 118,566 | A | * | 8/1871 | Weimer | 14/13 |
| 238,130 | A | * | 2/1881 | Lawrence | 14/4 |
| 428,338 | A | * | 5/1890 | Hill | 14/4 |
| 534,032 | A | * | 2/1895 | Clymer | 14/6 |
| 627,509 | A | * | 6/1899 | Koch | 14/4 |
| 762,632 | A | * | 6/1904 | Headley | 14/4 |
| 809,264 | A | * | 1/1906 | Humphreys | 14/14 |
| 824,502 | A | * | 6/1906 | Molloy | 52/653.2 |
| 1,153,099 | A | * | 9/1915 | Moore et al. | 14/3 |
| 2,856,644 | A | * | 10/1958 | Dunham | 52/223.12 |
| 3,909,863 | A | * | 10/1975 | Macrander et al. | 14/74.5 |
| 4,021,875 | A | * | 5/1977 | Abell et al. | 14/10 |
| 4,353,190 | A | * | 10/1982 | Gleeson | 52/223.12 |

(Continued)

FOREIGN PATENT DOCUMENTS

| | | | |
|---|---|---|---|
| EP | 1 396 582 | * | 3/2004 |
| JP | 2003-221809 | * | 8/2003 |

*Primary Examiner*—Gary S. Hartmann
(74) *Attorney, Agent, or Firm*—Wenderoth, Lind & Ponack, L.L.P.

(57) ABSTRACT

Through co-action between auxiliary triangular structural frames, which are each constructed at opposite ends of a truss girder or arch girder, and a cable stretched between the auxiliary triangular structural frames, an upwardly directed force is exerted to the truss girder or arch girder, thereby effectively inducing a load resisting force. A reinforcement structure of a truss bridge or arch bridge is comprised of a truss girder or arch girder, a first and a second end of which are each provided with a main triangular structural frame. The main triangular structural frame is provided at an inner side thereof with an auxiliary triangular structural frame. The auxiliary triangular structural frame is joined at vertexes thereof with frame structural elements at respective sides of the main triangular structural frame. A cable extends in a longitudinal direction of the truss bridge, being stretched between a nearby part of a joined part at one of the vertexes of the auxiliary triangular structural frame on a side of the first end of the truss girder or arch girder and a nearby part of a joined part at a corresponding one of the vertexes of the auxiliary triangular structural frame on a side of the second end of the truss girder or arch girder. Deflecting structure, adapted to exert a downwardly directed force to the cable, is inserted between the cable and a lower chord of the truss girder or arch girder so as to tension the cable, and an upwardly directed force is exerted to the lower chord by a reaction force attributable to tension of the cable via the deflecting structure.

9 Claims, 13 Drawing Sheets

U.S. PATENT DOCUMENTS 4,589,157 A * 5/1986 Richard ..... 14/73
4,620,400 A * 11/1986 Richard ..... 52/223.9
4,631,772 A * 12/1986 Bonasso ..... 14/20
5,065,467 A * 11/1991 Forsyth ..... 14/13
5,671,572 A * 9/1997 Siller-Franco ..... 52/223.8
6,065,257 A * 5/2000 Nacey et al. ..... 52/223.8
6,493,895 B1 * 12/2002 Reynolds ..... 14/4

* cited by examiner

REINFORCEMENT STRUCTURE OF TRUSS BRIDGE OR ARCH BRIDGE

BACKGROUND OF THE INVENTION

1. Field of the Invention

This invention relates to a reinforcement structure effective for improving a load resisting force of a truss bridge or an arch bridge constructed over a river or on land.

2. Related Art

There has heretofore been known, as a work for reinforcing a truss bridge or an arch bridge, a method in which a structural frame(s) of a truss girder or an arch girder, which constitutes the truss bridge or arch bridge, (more specifically, an upper chord, a lower chord and a diagonal member in the truss girder or a lower chord and a vertical member in the arch girder), are abutted and overlaid by a short reinforcement member and bolted together, so that a sectional area of each structural frame is increased to thereby enhance a load resisting force.

However, the above-mentioned reinforcement work requires such troublesome work that many reinforcement plates are needed and each sheet must be bolted. In addition, a long period of time is required for the work and working costs are increased.

Moreover, many bolt heads are projected from a joined part of the structural frame through a gusset plate. When the reinforcement plates are overlaid on an area of the structural frame which excludes this joined part, a problem arises in which a load resisting force is hardly enhanced at the joined part on which a dead load and an active load are concentrated.

In order to avoid this problem, large-scale work is required in which many bolts and gusset plates are removed from the joined part and replaced with a reinforcement plate and then bolted again.

SUMMARY OF THE INVENTION

It is, therefore, an object of the present invention to provide a reinforcement structure of a truss bridge or an arch bridge, in which, through co-action between auxiliary triangular structural frames which are each constructed at opposite ends of a truss girder or an arch girder and a cable stretched between the auxiliary triangular structural frames, an upwardly directed force is exerted to the truss girder or arch girder, thereby effectively inducing a load resisting force.

To achieve the above object, from one aspect of the present invention, there is provided a reinforcement structure of a truss bridge comprising a truss girder, a first and a second end of which are each provided with a main triangular structural frame. The main triangular structural frame is provided at an inner side thereof with an auxiliary triangular structural frame. The auxiliary triangular structural frame is joined at vertexes thereof with frame structural elements at respective sides of the main triangular structural frame. A cable extends in a longitudinal direction of the truss bridge, being stretched between a nearby part of a joined part at one of the vertexes of the auxiliary triangular structural frame on a side of the first end of the truss girder and a nearby part of a joined part at a corresponding one of the vertexes of the auxiliary triangular structural frame on a side of the second end of the truss girder. Deflecting structure, adapted to exert a downwardly directed force to the cable is inserted between the cable and a lower chord of the truss girder so as to tension the cable, and an upwardly directed force is exerted to the lower chord by a reaction for ce attributable to tension of the cable via the deflecting structure.

From another aspect of the invention, there is provided a reinforcement structure of an arch bridge comprising an arch girder, a first and a second end of which are each provided with a main triangular structural frame or main rectangular structural frame. This structural frame is provided at an inner side thereof with an auxiliary triangular structural frame. The auxiliary triangular structural frame is joined at vertexes thereof with frame structural elements at respective sides of the main triangular structural frame or main rectangular structural frame. A cable extends in a longitudinal direction of the arch bridge, being stretched between a nearby part of joined part at one of the vertexes of the auxiliary triangular structural frame on a side of the first end of the arch girder and a nearby part of a joined part at a corresponding one of the vertexes of the auxiliary triangular structural frame on a side of the second end of the arch girder. Deflecting structure, adapted to exert a downwardly directed force to the cable is inserted between the cable and a lower chord of the arch girder so as to tension the cable, and an upwardly directed force is exerted to the lower chord by a reaction force attributable to tension of the cable via the deflecting structure.

Preferably, the deflecting structure is constituted by a jack capable of controlling a downwardly directed force by controlling an extension/retraction amount of the jack.

DETAILED DESCRIPTION OF THE PREFERRED EMBODIMENTS

Figure 1:
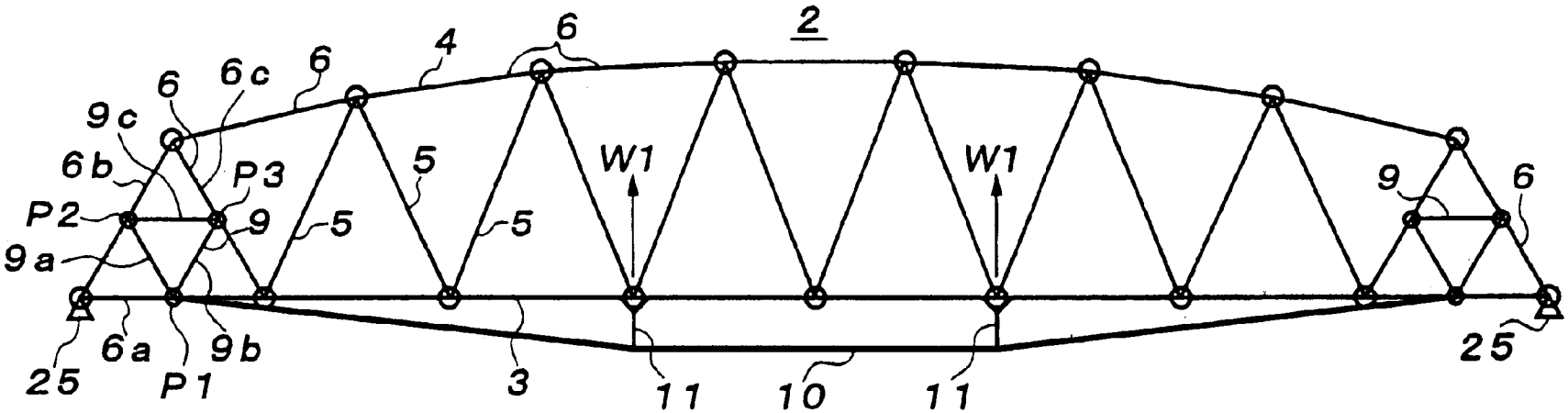
FIG. 1 is a side view schematically showing a reinforcement structure of a truss girder.

Embodiments of a reinforcement structure of a truss bridge or arch bridge according to the present invention will be described hereinafter with reference to FIG. 1 through FIG. 11.

As shown in FIGS. 1 through 7, a truss bridge is a bridge having two truss girders 2, each of which is constructed on each side in a sense of a road width direction of a floor slab 1. Each truss girder 2 has a structure in which a lower chord 3 and an upper chord 4 are joined by a plurality of diagonal members 5 which are inserted therebetween in a zigzag manner, thereby forming a plurality of main triangular frames 6 from one end of the truss girder 2 to the other end thereof.

Figure 8:
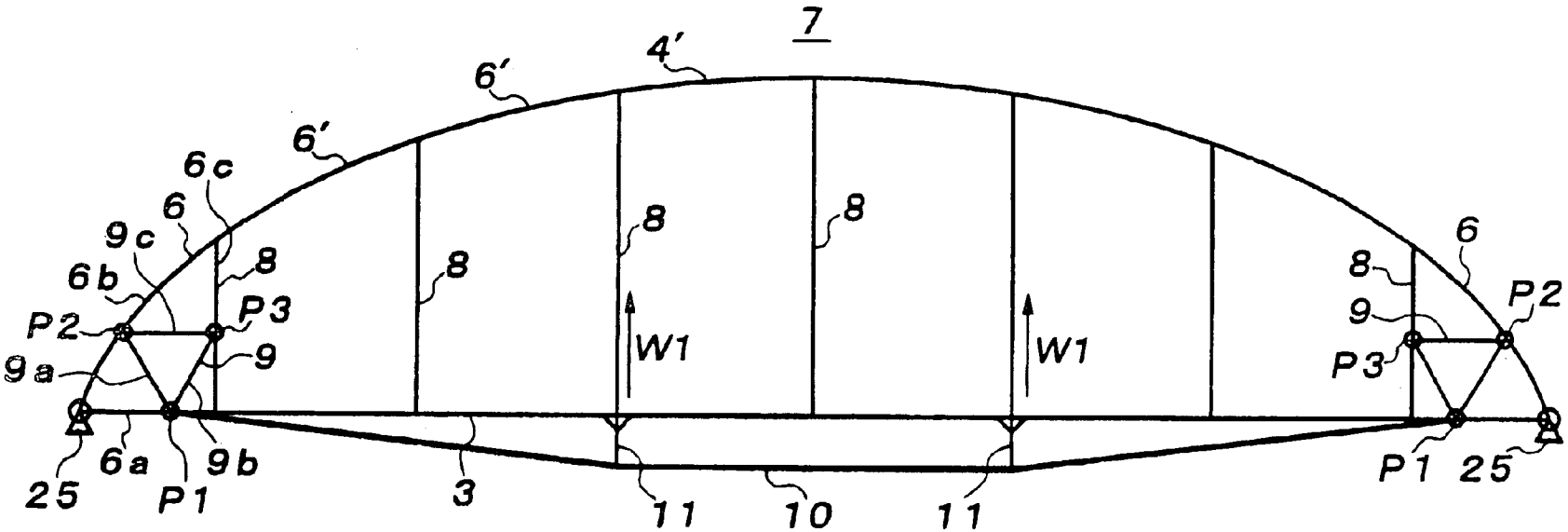
FIG. 8 is a side view schematically showing a reinforcement structure of an arch girder.
Figure 9:
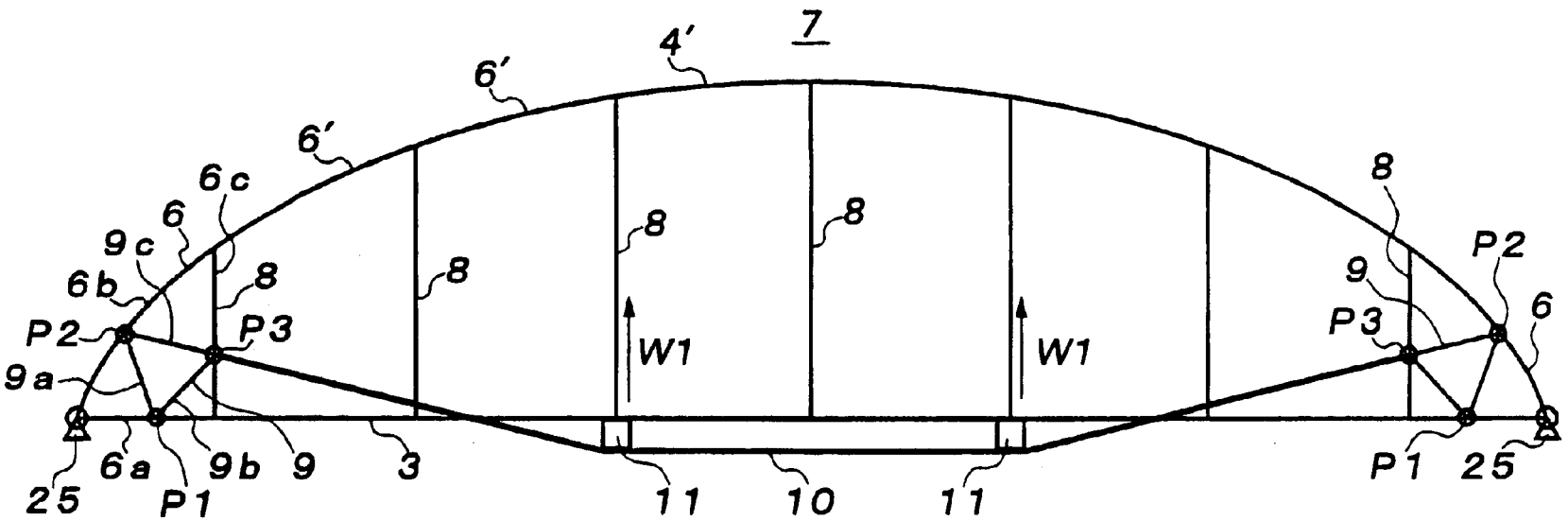
FIG. 9 is a side view schematically showing another example of a reinforcement structure of an arch girder.
Figure 10:
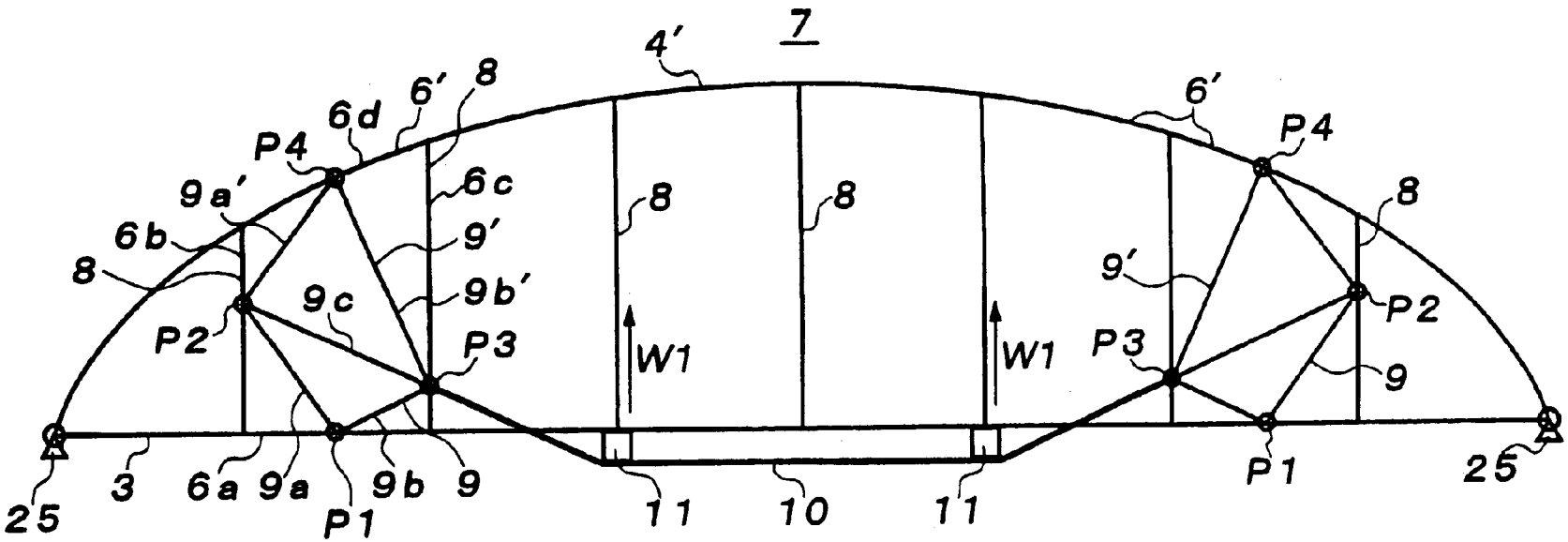
FIG. 10 is a side view schematically showing a further example of a reinforcement structure of an arch girder.

On the other hand, as shown in FIGS. 8 through 10, an arch bridge is a bridge having two arch girders 7, each of which is constructed on each side in a sense of a road width direction of a floor slab 1. The arch bridge has a structure in which a lower chord 3 and an arch member 4' are joined by a plurality of vertical members 8 inserted therebetween in a parallel relationship, thereby forming a plurality of rectangular structural frames 6' between two main triangular structural frames 6, each of which is formed at each end of the arch bridge.

The truss girders 2 and the arch girders 7, as well as other vertical girders 22, are supported, in a suspending manner, at opposite ends thereof on bridge legs 24.

The reinforcement structure of the truss bridge will be described first. FIGS. 1 through 4 show an example in which a truss girder 2 is arranged such that an upper chord 4 is located above a floor slab 1, and FIG. 5 shows a truss bridge in which a floor slab 1 is loaded onto a truss girder 2. The description to follow is common to these two truss girders.

As shown in FIGS. 1 through 7, a first and a second end of the truss girder 2 are each provided with a main triangular structural frame 6 which is further provided at an inner side thereof with an auxiliary triangular structural frame 9, and the auxiliary triangular structural frame 9 is joined at vertexes thereof with frame structural elements at respective sides of the main triangular structural frame 6. Therefore, each auxiliary triangular structural frame 9 includes joined parts P1, P2 and P3 which correspond to respective vertexes of a triangle.

It is most effective to construct the auxiliary triangular structural frame 9 inside the main triangular structural frame 6 which is formed at each end of the truss bridge. However, it may also be constructed inside a main triangular structural frame 6 which is formed inwardly of the main triangular structural frame 6 which is formed at each end of the truss bridge. That is, auxiliary triangular structural frames 9 are each mounted on first and second end sides of the truss bridge.

Each main triangular structural frame 6 comprises three main structural frame elements 6*a*, 6*b* 6*c*. Main structural frame element 6*a* comprises a lower chord part, and main structural frame elements 6*b*, 6*c* comprise two diagonal members 5 which are adapted to interconnect opposite ends of the main structural frame element 6*a* and the upper chord 4. The main structural frame elements 6*a*, 6*b*, 6*c* form respective sides of a triangle.

On the other hand, each auxiliary triangular structural frame 9 comprises three auxiliary structural frame elements 9*a*, 9*b*, 9*c*. Auxiliary structural frame element 9*a* comprises a diagonal member for joining an intermediate part of the main structural frame element 6*b* (one diagonal member 5) and an intermediate part of the main structural frame element 6*a*, and auxiliary structural frame element 9*b* comprises a diagonal member for joining an intermediate part of the main structural frame element 6*c* (another diagonal member 5) and an intermediate part of the main structural frame element 6*a*. Auxiliary structural frame element 9*c* comprises a chord for joining an intermediate part of the main structural element 6*b* as the one diagonal member 5 and an intermediate part of the main structural frame element 6*c* as the another diagonal member 5.

Accordingly, the auxiliary structural frame elements 9*a*, 9*b* of the auxiliary triangular structural frame 9 are bolted to the intermediate part of the main structural frame element 6*a* through a gusset plate 12*a*, the auxiliary structural frame elements 9*a*, 9*c* are bolted to the intermediate part of the main structural frame element 6*b* through a gusset plate 12*b*, and the auxiliary structural frame elements 9*b*, 9*c* are bolted to the intermediate part of the main structural frame element 6*c* through a gusset plate 12*c*, thereby forming the joined parts P1, P2, P3.

A cable 10 extending in a longitudinal direction of the bridge is stretched between a nearby area of the joined part at the vertex of the auxiliary triangular structural frame 9 which is located on the first end side and a nearby area of the joined part at a corresponding vertex of the auxiliary triangular structural frame 9 which is located on the second end side. Deflecting structure 11 for exerting a downwardly directed force to the cable 10 is inserted between the cable 10 and lower chord 3 of truss girder 2, so that an upwardly directed force W1, caused by a reaction force attributable to tension of the cable 10, is exerted to the lower chord 3 via the deflecting structure 11.

The deflecting structure 11 is attached to the lower chord 3 by a bolt or the like such that the deflecting structure 11 is projected downwardly with its lower end supporting the cable 10.

As one preferable example, as shown in FIGS. 1 and 2, the cable 10 extending in the longitudinal direction of the bridge is stretched between the joined parts P1, P1 at the vertexes of the auxiliary triangular structural frames 9 with respect to the lower chord 3, i.e., between the joined parts P1, P1 of the main structural frame elements 6*a* with respect to the auxiliary structural frame elements 9*a*, 9*b*, on the first and second end sides. Deflecting structure 11 for exerting a downwardly directed force to the cable 10 is inserted for tensioning the cable 10 between the cable 10 and the lower chord 3 of the truss girder 2, so that an upwardly directed force W1 is exerted to the lower chord 3 through the deflecting structure 11 and an upwardly directed force W1 is exerted to the bridge through the lower chord 3, while exerting a tensile force to the joined parts P1, P1, by the reaction force attributable to tension of the cable 10.

Figure 3:
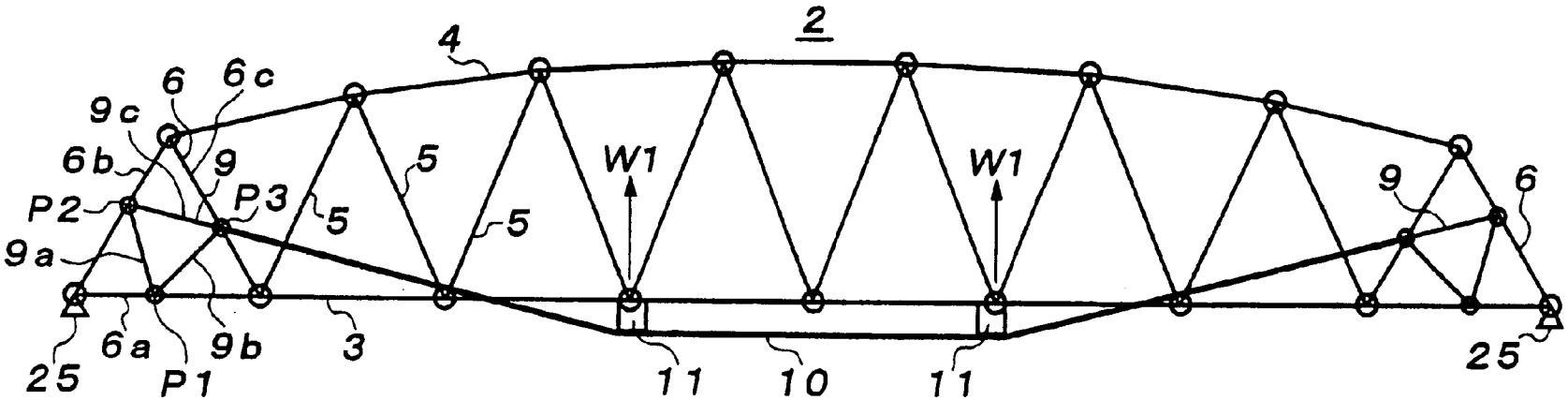
FIG. 3 is a side view schematically showing another example of a reinforcement structure of a truss girder.
Figure 4:
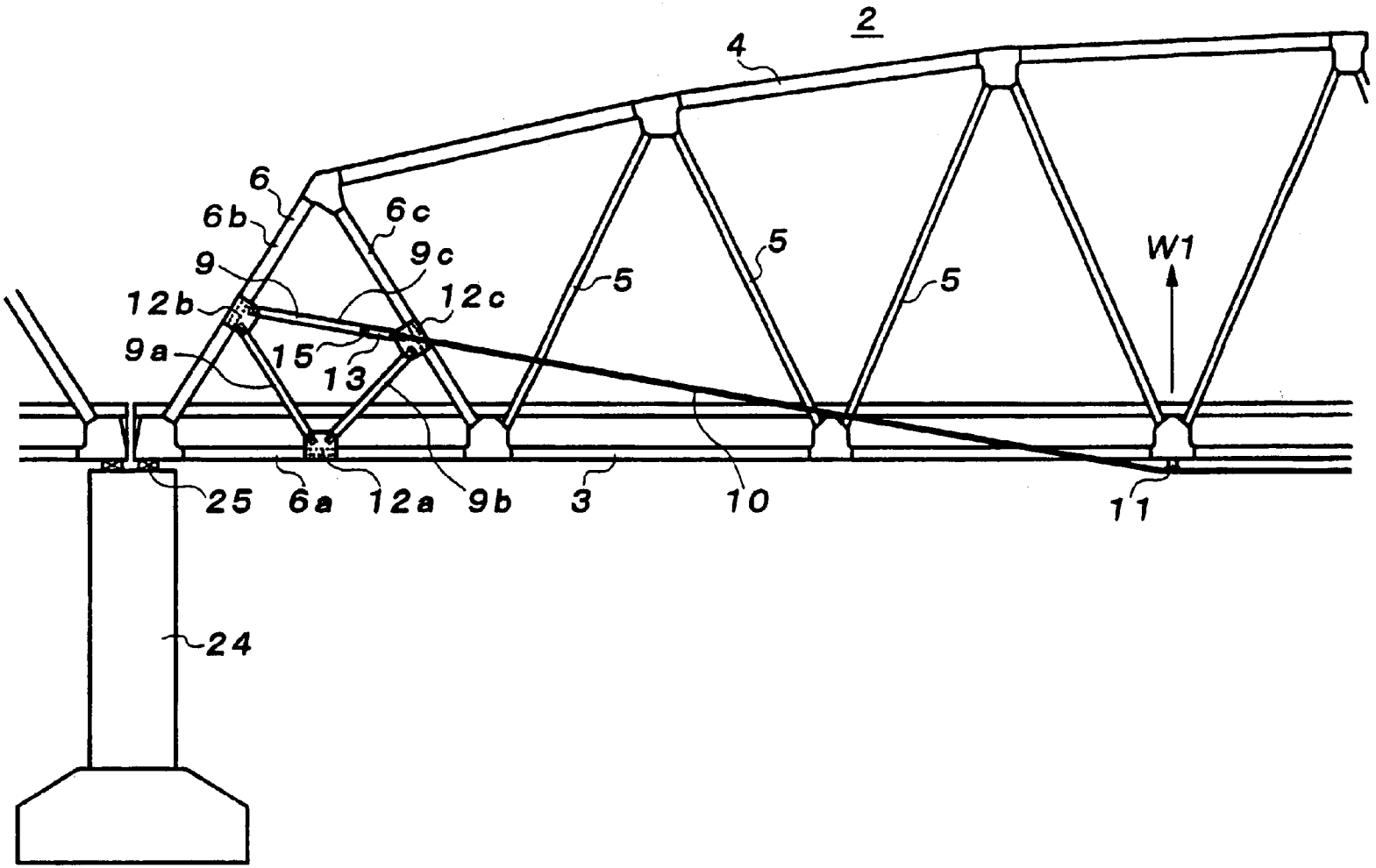
FIG. 4 is an enlarged side view of a reinforcement structural part of FIG. 3.
Figure 5:
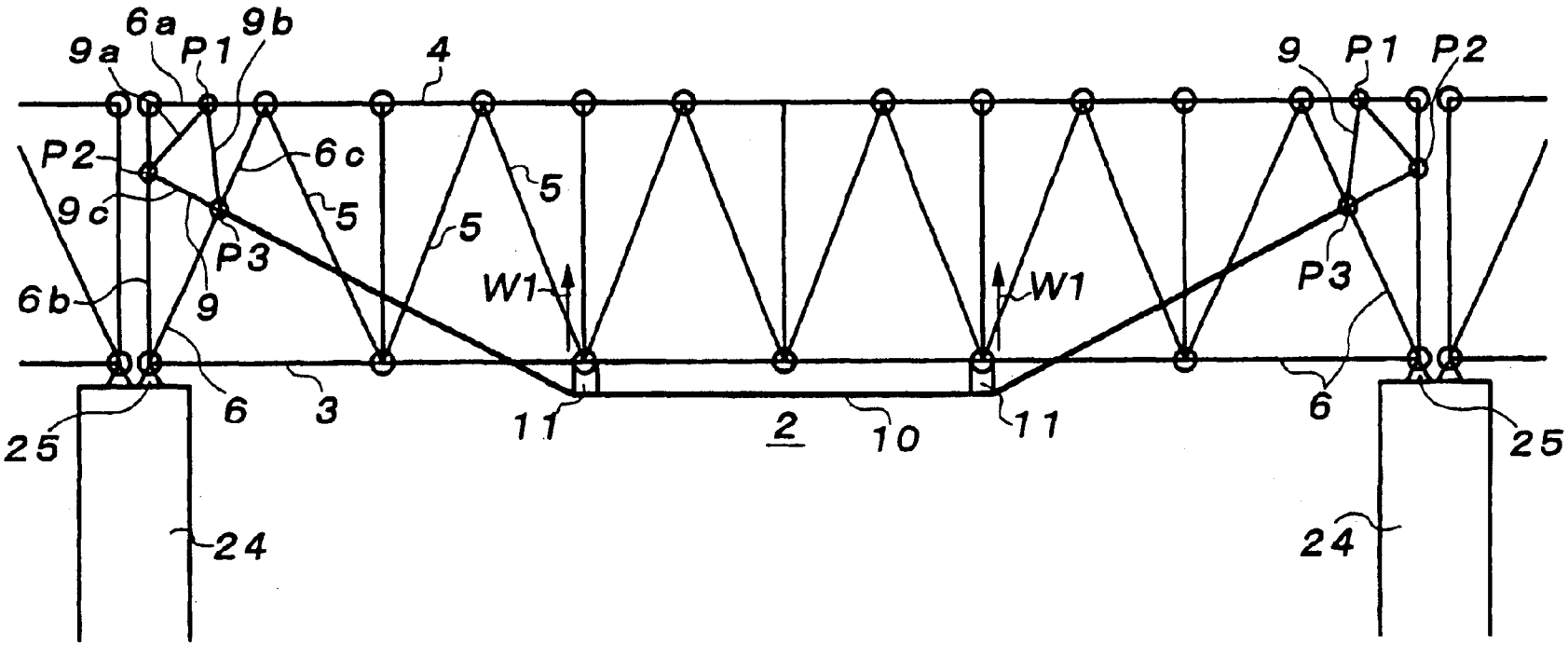
FIG. 5 is a side view schematically showing a reinforcement structure of a truss bridge having such a structure that a floor plate is loaded on a truss girder.

As another preferable example, as shown in FIGS. 3 and 4, a cable 10 extending in the longitudinal direction of the bridge is stretched between the joined parts P3, P3 at the vertexes of the auxiliary triangular frames 9 with respect to the main structural frame elements 6*c*, i.e., between the joined parts P3, P3 of the main structural frame elements 6*c* with respect to the auxiliary structural frame elements 9*b*, 9*c*, on the first and second end sides. Deflecting structure 11 for exerting a downwardly directed force to the cable 10 is inserted for tensioning the cable 10 between the cable 10 and the lower chord 3 of the truss girder 2, so that an upwardly directed force W1 is exerted to the lower chord 3 via the deflecting structure 11 and an upwardly directed force W1 is exerted to the bridge via the lower chord 3, while exerting a tensile force to the joined parts P3, P3, by a reaction force attributable to tension of the cable 10.

Similarly, in the arch bridge, as shown in FIGS. 8 and 9, a first and a second end of an arch girder 7 are each provided with a main triangular structural frame 6 or, as shown in FIG. 10, a main rectangular structural frame 6', which is further provided at an inner side thereof with an auxiliary triangular structural frame 9. The auxiliary triangular structural frame 9 is joined at vertexes thereof with frame structural elements at respective sides of the main triangular structural frame 6 or main rectangular structural frame 6'. Therefore, each auxiliary triangular structural frame 9 includes three joined parts P1, P2, P3 which correspond to vertexes of a triangle.

In the same manner as described above, the main triangular structural frames 6 on first and second ends of the arch girder 7 each comprise three main structural frame elements 6*a*, 6*b*, 6*c*. Main structural frame element 6*a* comprises an end part (first or second end part) of the lower chord 3, main structural frame element 6*b* comprises an end part (first or second end part) of the arch member 4', and main structural frame element 6*c* comprises a vertical member 8 on an end (first end or second end) of the lower chord 3. The main structural frame elements 6*a*, 6*b*, 6*c* form respective sides of a triangle.

On the other hand, the auxiliary triangular structural frame 9 comprises three auxiliary structural frame elements 9*a*, 9*b*, 9*c*. Auxiliary structural frame element 9*a* comprises a diagonal member for joining an intermediate part of the main structural frame element 6*b* (first or second end part of the arch member 4') and an intermediate part of the main structural frame element 6*a* (first or second end part of the lower chord 3), and auxiliary structural frame element 9*b* comprises a diagonal member for joining an intermediate part of the main structural frame element 6*c* (the vertical member 8) and an intermediate part of the main structural frame element 6*a* (first or second end part of the lower chord 3). Auxiliary structural frame element 9*c* comprises a chord for joining an intermediate part of the main structural element 6*b* as the first or second end part of the arch member 4' and an intermediate part of the main structural frame element 6*c* as the vertical member 8.

Accordingly, the auxiliary structural frame elements 9*a*, 9*b* of the auxiliary triangular structural frame 9 are bolted to the intermediate part of the main structural frame element 6*a* through a gusset plate 12*a*, the auxiliary structural frame elements 9*a*, 9*c* are bolted to the intermediate part of the main structural frame element 6*b* through a gusset plate 12*b*, and the auxiliary structural frame elements 9*b*, 9*c* are bolted to the intermediate part of the main structural frame element 6*c* through a gusset plate 12*c*, thereby forming the joined parts P1, P2, P3.

As shown in FIG. 10, the main rectangular structural frames 6' located between the main triangular structural frames 6, 6 on the first and second ends of the arch girder 7 each comprise four main structural frame elements 6*a*, 6*b*, 6*c*, 6*d*. Main structural frame element 6*a* comprises a lower chord part, main structural frame elements 6*b*, 6*c* comprise two vertical members 8 which are adjacent to each other in a parallel relationship, and main structural frame element 6*d* comprises an arch member part. The main structural frame elements 6*a*, 6*b*, 6*c*, 6*d* form respective sides of a rectangular shape.

On the other hand, the auxiliary triangular structural frame 9 comprises three auxiliary structural frame elements 9*a*, 9*b*, 9*c*. Auxiliary structural frame element 9*a* comprises a diagonal member for joining an intermediate part of the main structural frame element 6*b* (one vertical member 8) and an intermediate part of the main structural frame element 6*a* (the lower chord part), and auxiliary structural frame element 9*b* comprises a diagonal member for joining an intermediate part of the main structural frame element 6*c* (the other vertical member 8) and an intermediate part of the main structural frame element 6*a* (the lower chord part). Auxiliary structural frame element 9*c* comprises a chord for joining an intermediate part of the main structural element 6*b* as the one vertical member 8 and an intermediate part of the main structural frame element 6*c* as the other vertical member 8.

Accordingly, the auxiliary structural frame elements 9*a*, 9*b* of the auxiliary triangular structural frame 9 are bolted to the intermediate part of the main structural frame element 6*a* through a gusset plate 12*a*, the auxiliary structural frame elements 9*a*, 9*c* are bolted to the intermediate part of the main structural frame element 6*b* through a gusset plate 12*b*, and the auxiliary structural frame elements 9*b*, 9*c* are bolted to the intermediate part of the main structural frame element 6*c* through a gusset plate 12*c*, thereby forming the joined parts P1, P2, P3.

In FIG. 10, a pair of auxiliary triangular structural frames 9, 9' commonly have the auxiliary structural frame element 9*c* as a chord, and auxiliary structural frame elements 9*a'*, 9*b'*, which comprise diagonal members of the auxiliary triangular frame 9', are joined to an intermediate part of the main structural frame 6*d* which comprises an arch member part through a gusset plate 12*d*, thereby forming joined parts P1, P2, P3, P4.

In other words, a parallelogrammic structural frame, which comprises the auxiliary structural frame elements 9*a*, 9*b*, 9*a'*, 9*b'*, is constructed at an inner side of the main rectangular structural frame 6'. A diagonal member comprising the auxiliary structural frame element 9*c* is inserted along a diagonal line which joins opposing vertexes of the parallelogrammic structural frame, and respective vertexes of the parallelogrammic structural frame are joined to intermediate parts of the main structural frame members 6*a*, 6*b*, 6*c*, 6*d*.

In the arch bridge, a cable 10 extending in a longitudinal direction of the arch bridge is stretched between a nearby part of a joined part at a vertex of the auxiliary triangular structural frame 9 on a side of the first end of the arch girder and a nearby part of a joined part at a corresponding vertex of the auxiliary triangular structural frame 9 on a side of the second end of the arch girder. Deflecting structure 11 adapted to exert a downwardly directed force to the cable 10 is inserted between the cable 10 and the lower chord 3 of the arch girder member 4' so as to tension the cable 10, and an upwardly directed force W1 is exerted to the lower chord 3 by a reaction force attributable to tension of the cable 10 via the deflecting structure 11.

The deflecting structure 11 is attached to the lower chord 3 by a bolt or the like such that the deflecting structure 11 is projected downwardly with its lower end supporting the cable 10.

As one preferable example, as shown in FIG. 8, the cable 10 extending in the longitudinal direction of the bridge is stretched between the joined parts P1, P1 of the vertexes of the auxiliary triangular structural frames 9 with respect to the lower chord 3, i.e., between the joined parts P1, P1 of the main structural frame elements 6*a* with respect to the auxiliary structural frame elements 9*a*, 9*b*, on the first and second ends. Deflecting structure 11 for exerting a downwardly directed force to the cable 10 is inserted for tensioning the cable 10 between the cable 10 and the lower chord 3, so that an upwardly directed force W1 is exerted to the lower chord 3 via the deflecting structure 11, wherein the upwardly directed force W1 is exerted to the lower chord 3, while exerting a tensile force to the joined parts P1, P1, by a reaction force attributable to tension of the cable 10.

As another preferable example, as shown in FIGS. 9 and 10, a cable 10 extending in the longitudinal direction of the bridge is stretched between the joined parts P3, P3 of the vertexes of the auxiliary triangular frames 9 with respect to the main structural frame elements 6*c*, i.e., between the joined parts P3, P3 of the main structural frame elements 6*c* with respect to the auxiliary structural frame elements 9*b*, 9*c*, on the first and second end sides. Deflecting structure 11 for exerting a downwardly directed force to the cable 10 is inserted, for tensioning the cable 10, between the cable 10 and the lower chord 3, so that an upwardly directed force W1 is exerted to the lower chord 3 via the deflecting structure 11, wherein the upwardly directed force W1 is exerted to the bridge through the lower chord 3, while exerting a tensile force to the joined parts P3, P3, by a reaction force attributable to tension of the cable 10.

Plural deflecting structure 11 are provided depending on a supporting interval length of the truss bridge or arch bridge. When two deflecting structures are provided, the cable 10 in the truss bridge or arch bridge diagonally extends between the joined part P1 and the deflecting structure 11 on the first end and between the joined part P3 and the deflecting structure 11 on the second end, and the cable horizontally extends between the deflecting structure 11, 11.

When opposite ends of the cable 10 are joined to the joined parts P3, the auxiliary structural frame element 9*c* is diagonally oriented along a diagonal axis at a diagonally extending part of the cable 10.

Figure 2A:
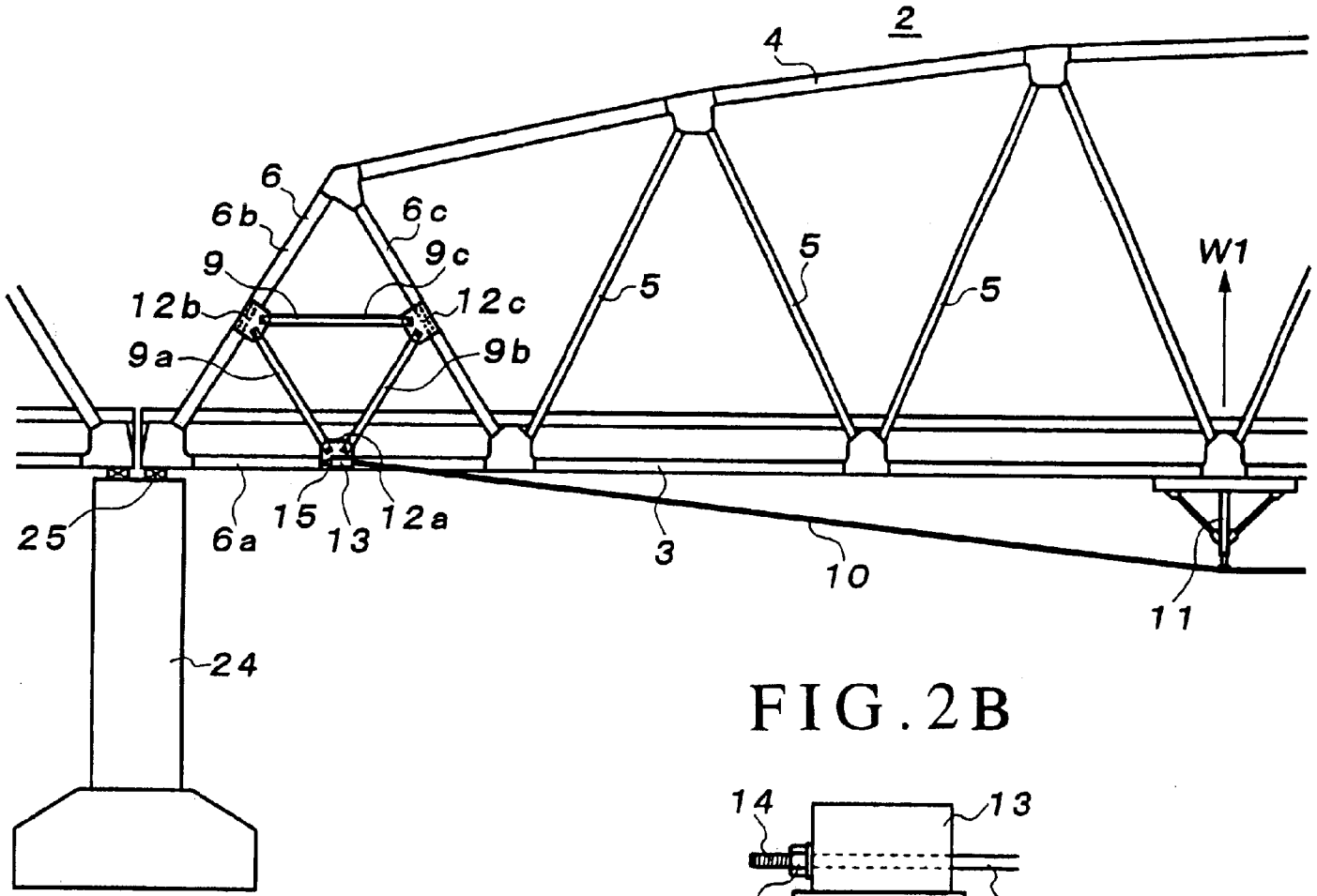
FIG. 2(A) is an enlarged side view of a reinforcement structural part of FIG. 1.
Figure 2B:
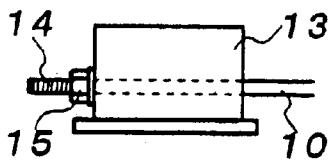
FIG. 2(B) is an enlarged side view of an anchor part of a cable.

The cable 10 in the truss bridge or arch bridge used in this embodiment is a steel cable called "PC cable", in which opposite ends of the cable are provided with male threads 14. As shown in FIGS. 2A, 2B and 4, cable threaders 13 are each attached to the joined parts P1, P3, and the opposite ends of the cable 10 are inserted in the cable threaders 13. A nut 15 is threadingly engaged with male threads 14 of the cable 10 at an outer end of the cable threader 13, and the nut 15 is abutted with an outer end of the cable threader 13 so that a tensioning state of the cable 10 can be maintained.

That is, the opposite ends or one end of the cable 10 is pulled by a towing machine to create a tensioning state of the cable 10. In that state, the nut 15 is threadingly advanced and abutted with the outer end of the cable threader 13 to maintain the tensioning state of the cable 10. Accordingly, the nut 15 constitutes a stopper against tensile force.

Figure 6:
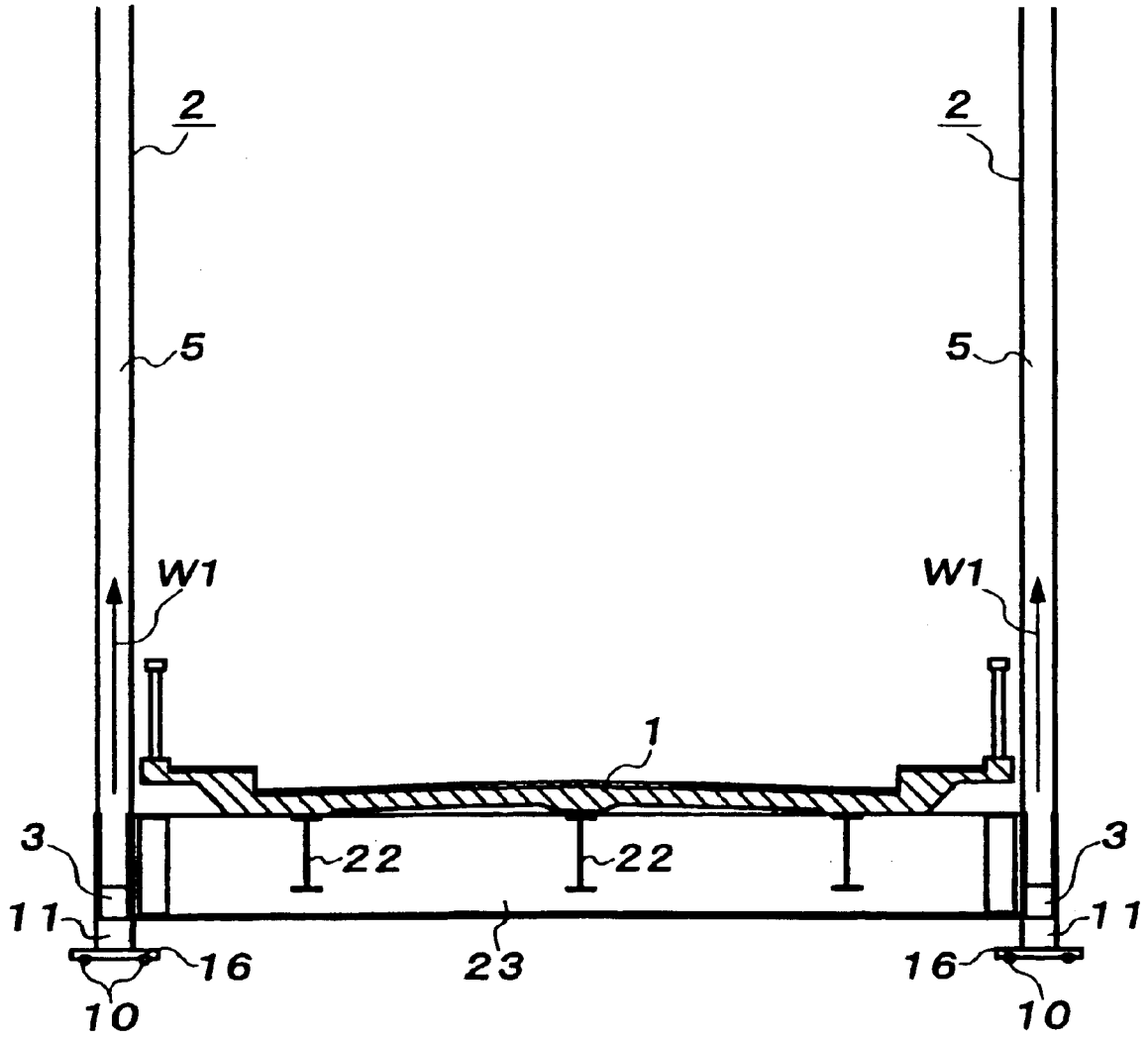
FIG. 6 is a sectional view, when viewed in a widthwise direction of a bridge, showing a part provided with deflecting structure in the truss girder of FIGS. 1 through 4.

In that tensioning state, the cable 10 is, as shown in FIG. 6, inserted into a cable guide groove 16 formed in a cable guide at a lower end of the deflecting structure 11 and urged hard against the deflecting structure 11, and tensioned in a state in which a relatively downwardly directed force is exerted to the cable 10. As a reaction force of this downwardly directed force, an upwardly directed force W1 is generated.

A single or plural cables 10 are stretched on one side in a widthwise direction of the bridge. When plural cables 10 are stretched on opposite sides, a plurality of the cable guide grooves 16 are formed in parallel.

The floor slab 1 is supported by vertical girders 22, which are formed of an H-shaped steel extending in the longitudinal direction of the bridge, and a horizontal girder 23 which is formed of an H-shaped steel for joining the vertical girders 22. Opposite ends of the horizontal girder 23 are joined to the lower chord 3, of the truss girder 2 or arch girder 7. The upwardly directed force W1 is exerted to the vertical girders 22 through the horizontal girder 23, thereby exerting the upwardly directed force W1 to the bridge in its entirety.

A prop post formed of steel or the like is used as the deflecting structure 11. Preferably, a jack which can be adjusted in terms of a downwardly directed force by controlling an extension/retraction amount is used as the deflecting structure 11.

As the jack, a jack having a hydraulic cylinder structure or pneumatic cylinder structure can be used.

Figure 11A:
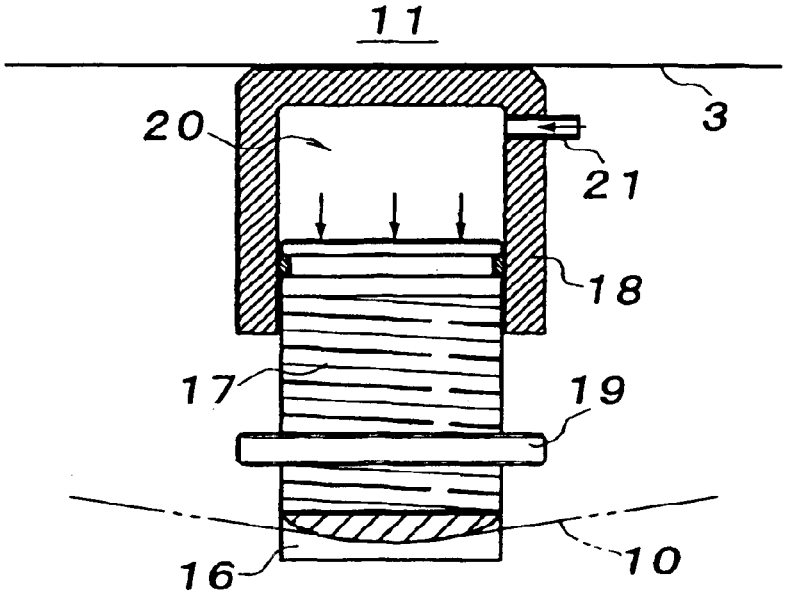
FIGS. 11(A) and 11(B) are sectional views showing an operating state of a jack forming the deflecting structure.
Figure 11B:
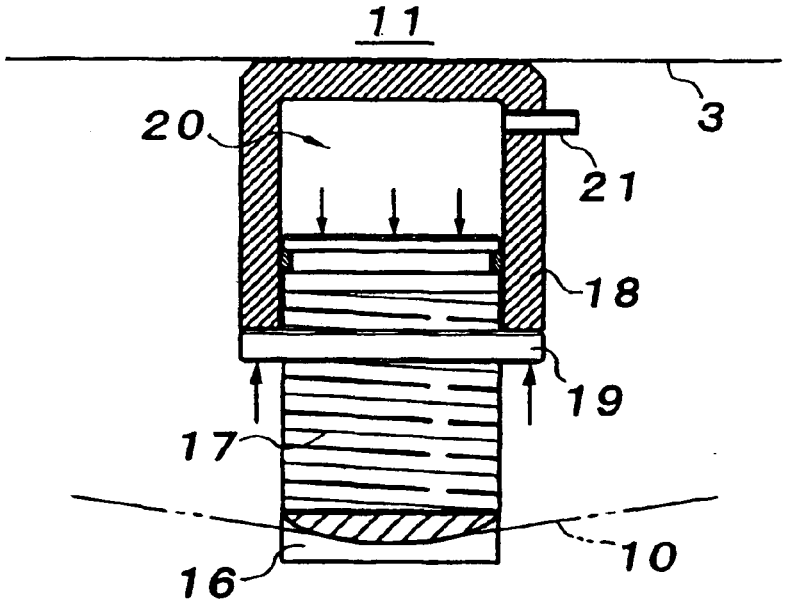

A thread type jack can also be used. Particularly preferably, a hydraulic thread type jack 11, as shown in FIGS. 11A and 11B, may be used which can be extended/retracted by hydraulic pressure and which can be fixed in an extended or retracted position by threaded engagement.

That is, a jack 11 is used which has both a hydraulic cylinder structure and a thread type jack structure. In this jack 11, one end of a cylinder rod 17 is slidingly fitted airtight inside of cylinder 18, and a male thread is formed at an outer peripheral surface of another end part of the cylinder rod 17 which projects from the cylinder 18. A stopper flange 19 is threadingly engaged with the male thread, and a hydraulic pressure feed port 21 for supplying a hydraulic pressure into a hydraulic chamber 20 formed at a lower surface of the cylinder rod 17 at an inner bottom part of the cylinder 18 is provided in the cylinder 18.

By supplying hydraulic pressure through the hydraulic pressure feed port 21, the cylinder rod 17 is extended by a constant extending amount, thereby exerting a constant tensioning force (downwardly directed force) to the cable 10.

Then, the downwardly directed force exerted to the cable 10 is confirmed by a pressure gauge. In a state in which the downwardly directed force is exerted to the cable 10, the stopper flange 19 is threadingly retracted along the cylinder rod 17 and sat on an end face of the cylinder 18. Hence, retraction of the cylinder rod 17 is prohibited and extension is retained so that the downwardly directed force exerted to the cable 10 is set and retained.

After this extending state is retained by prohibiting threading retraction of cylinder rod 17 by the stopper flange 19, hydraulic pressure within the hydraulic chamber 20 is extracted through the hydraulic pressure feed port 21. Thereafter, a downwardly directed pressure exerted to the cable 10 is maintained by thread type cylinder rod 17, thereby maintaining a tensioning state of the cable 10.

In case the cable 10 is loosened with passage of time, hydraulic pressure is supplied again, so that a tensioning state can be corrected and a downwardly directed force can be corrected.

Figure 12:
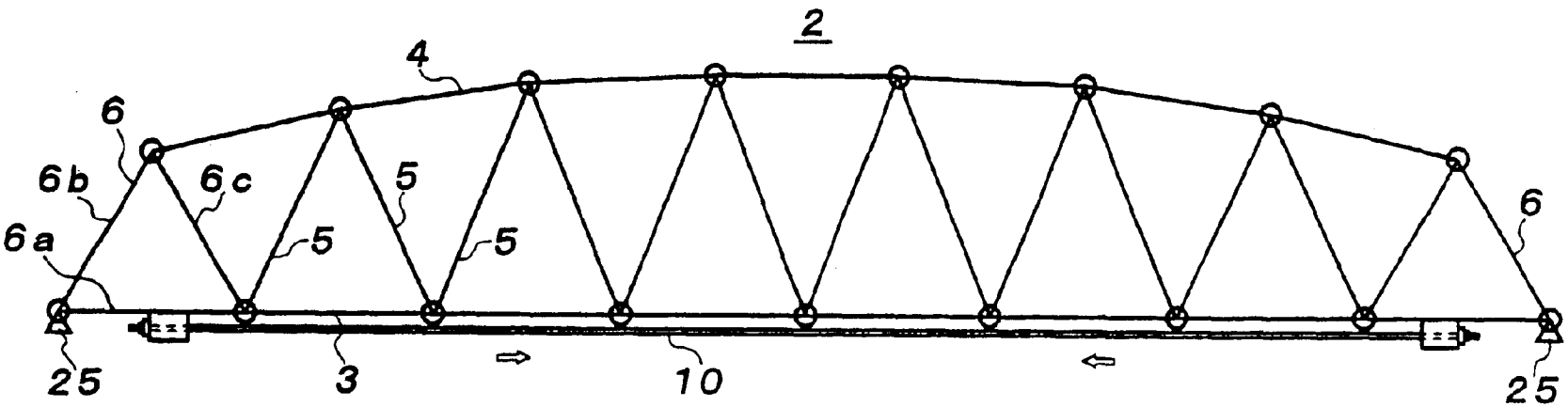
FIG. 12 is a side view of a reinforcement structure of a truss bridge showing a comparative example of the present invention.
Figure 13:
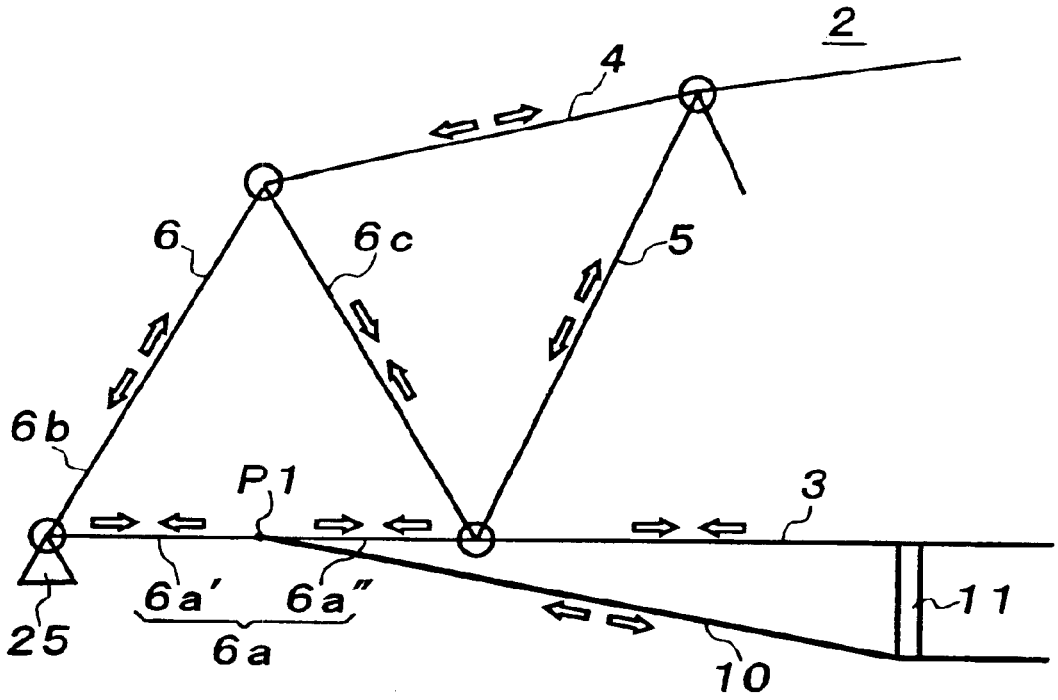
FIG. 13 is a side view showing another comparative example of the present invention.

FIGS. 12 and 13 show comparison examples of the present invention. That is, as shown in FIG. 12, when opposite ends of cable 10 are stretched between opposite ends of truss girder 2 or arch girder 7 without providing the auxiliary triangular structural frame 9 and the deflecting structure 11, a tensioning force of the cable 10 merely exerts a main axial force (compressive force), as indicated by arrows, to lower chord 3, and a force is not effectively transmitted to other main structural frames, i.e., upper chord 4 and diagonal member 5 in the truss girder 2, or arch member 4' and vertical member 8 in the arch girder 7, thereby reducing a reinforcement effect thereof.

As shown in FIG. 13, when deflecting structure 11 is provided between the cable 10 and the lower chord 3 of FIG. 12 and no auxiliary triangular structural frame 9 is provided, an axial force (compressive force and pulling force) as indicated by arrows of FIG. 13 is applied to the main triangular structural frame 6 of respective girders 2, 7.

Particularly, when the auxiliary triangular structural frame 9 is not provided, in the main structural frame 6*a* formed by each end part (first or second end part) of the lower chord 3, an axial force as indicated by arrows is applied to an outer main structural frame element part 6*a*' and an inner main structural frame element part 6*a*" with respect to joined part P1. As a result, a strong shearing force and a bending moment are applied to the joined part P1.

Figure 7:
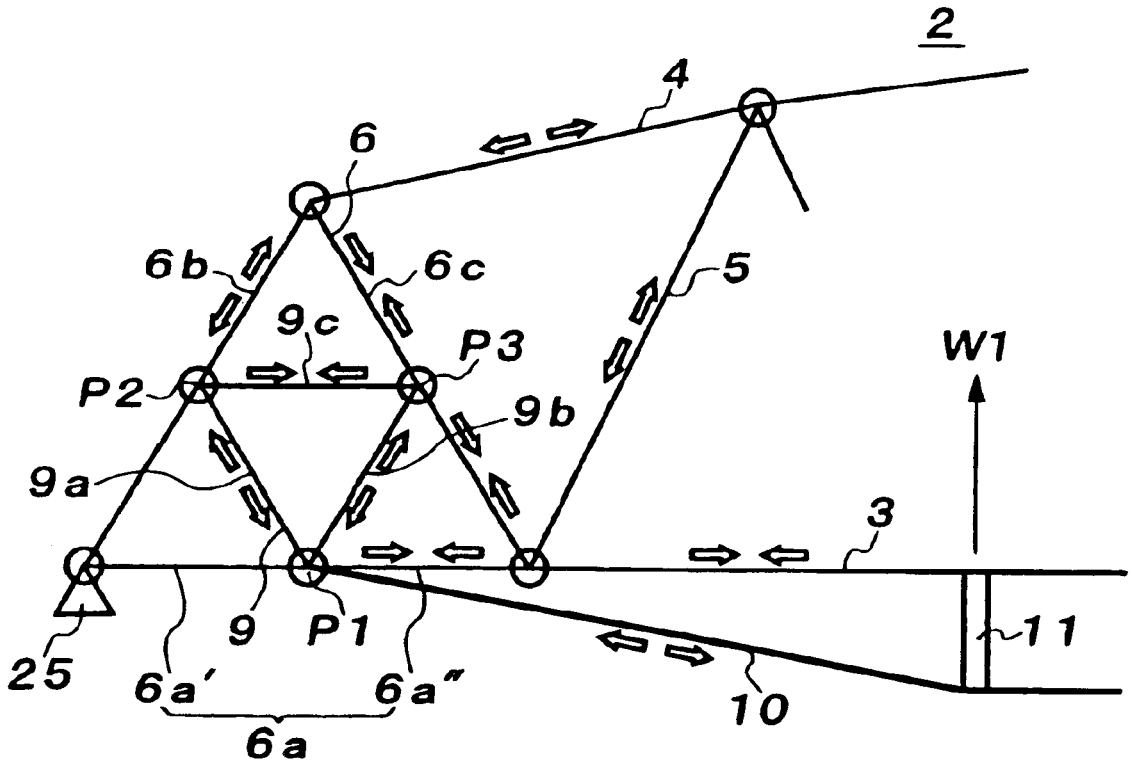
FIG. 7 is a side view showing an axial force in each part of the reinforcement structures of FIGS. 1 and 2.

On the other hand, as shown in FIG. 7, when the auxiliary triangular structural frame 9 is provided and the cable 10 is stretched between the joined parts P1, P1, no axial force is applied to the outer main structural frame element part 6*a*' with respect to a corresponding one of the joined parts P1 at all, and no shearing force nor bending moment are applied thereto.

The tensioning force of the cable 10 is effectively transmitted to other main structural frame members, i.e., the upper chord 4 and the diagonal member 5 in the truss girder 2 or the arch member 4' and the vertical member 8 in the arch girder 7, while exerting an axial force (compressive force) to the lower chord 3, so that a reinforcement effect thereof is effectively induced. Hence, the present invention is suitable as a reinforcement structure of a truss girder 2 or an arch girder 7.

Obviously, many modifications and variations of the present invention are possible in light of the above teachings. It is, therefore, to be understood that within the scope of the appended claims, the invention may be practiced otherwise than as specifically described.

What is claimed is:

1. A reinforcement structure for a truss bridge having a truss girder, the truss girder having a lower chord and being provided at each end thereof with a main structural frame composed of main structural frame elements, said reinforcement structure comprising:

an auxiliary structural frame positioned within each main structural frame, and connected to the main structural frame elements of this main structural frame at connection points;

a cable extending in a longitudinal direction of the truss bridge, said cable being connected to and extending between one of the connection points at one end of the truss girder and a corresponding one of the connection points at another end of the truss girder; and deflecting structure, positioned between said cable and the lower chord of the truss girder, for exerting a downwardly directed force to said cable such that an upwardly directed force, corresponding to a reaction force attributable to tension of said cable, is exerted to the lower chord of the truss girder.

2. The reinforcement structure according to claim 1, wherein each main structural frame and each auxiliary structural frame are triangular in shape, with said connection points corresponding to vertexes of said each auxiliary structural frame.

3. The reinforcement structure according to claim 2, wherein each main structural frame includes first, second and third main structural frame elements interconnected with one another to define the triangular shape of this main structural frame, and each auxiliary structural frame includes first, second and third auxiliary structural frame elements, with each of said first, second and third auxiliary frame elements having first and second ends such that the vertexes of said each auxiliary structural frame include a first vertex corresponding to a position where the first end of said first auxiliary frame element and the first end of said second auxiliary frame element are located, a second vertex corresponding to a position where the second end of said second auxiliary frame element and the first end of said third auxiliary frame element are located, and a third vertex corresponding to a position where the second end of said third auxiliary frame element and the second end of said first auxiliary frame element are located, such that said connection points at each end of the truss girder correspond to where the first end of said first auxiliary frame element and the first end of said second auxiliary frame element are connected to an intermediate part of the first main structural frame element, the second end of said second auxiliary frame element and the first end of said third auxiliary frame element are connected to an intermediate part of the second main structural frame element, and the second end of said third auxiliary frame element and the second end of said first auxiliary frame element are connected to an intermediate part of the third main structural element.

4. A reinforcement structure for an arch bridge having an arch girder, the arch girder having a lower chord and being provided at each end thereof with a main structural frame composed of main structural frame elements, said reinforcement structure comprising:

an auxiliary structural frame positioned within each main structural frame, and connected to the main structural frame elements of this main structural frame at connection points;

a cable extending in a longitudinal direction of the arch bridge, said cable being connected to and extending between one of the connection points at one end of the arch girder and a corresponding one of the connection points at another end of the arch girder; and deflecting structure, positioned between said cable and the lower chord of the arch girder, for exerting a downwardly directed force to said cable such that an upwardly directed force, corresponding to a reaction force attributable to tension of said cable, is exerted to the lower chord of the arch girder.

5. The reinforcement structure according to claim 4, wherein each main structural frame and each auxiliary structural frame are triangular in shape, with said connection points corresponding to vertexes of said each auxiliary structural frame.

6. The reinforcement structure according to claim 5, wherein each main structural frame includes first, second and third main structural frame elements interconnected with one another to define the triangular shape of this main structural frame, and each auxiliary structural frame includes first, second and third auxiliary structural frame elements, with each of said first, second and third auxiliary frame elements having first and second ends such that the vertexes of said each auxiliary structural frame include a first vertex corresponding to a position where the first end of said first auxiliary frame element and the first end of said second auxiliary frame element are located, a second vertex corresponding to a position where the second end of said second auxiliary frame element and the first end of said third auxiliary frame element are located, and a third vertex corresponding to a position where the second end of said third auxiliary frame element and the second end of said first auxiliary frame element are located, such that said connection points at each end of the truss girder correspond to where the first end of said first auxiliary frame element and the first end of said second auxiliary frame element are connected to an intermediate part of the first main structural frame element, the second end of said second auxiliary frame element and the first end of said third auxiliary frame element are connected to an intermediate part of the second main structural frame element, and the second end of said third auxiliary frame element and the second end of said first auxiliary frame element are connected to an intermediate part of the third main structural element.

7. The reinforcement structure according to claim 4, wherein each main structural frame is rectangular in shape and each auxiliary structural frame is triangular in shape, with said connection points corresponding to vertexes of said each auxiliary structural frame.

8. The reinforcement structure according to claim 7, wherein each main structural frame includes first, second, third and fourth main structural frame elements interconnected with one another to define the rectangular shape of this main structural frame, and each auxiliary structural frame includes first, second and third auxiliary structural frame elements, with each of said first, second and third auxiliary frame elements having first and second ends such that the vertexes of said each auxiliary structural frame include a first vertex corresponding to a position where the first end of said first auxiliary frame element and the first end of said second auxiliary frame element are located, a second vertex corresponding to a position where the second end of said second auxiliary frame element and the first end of said third auxiliary frame element are located, and a third vertex corresponding to a position where the second end of said third auxiliary frame element and the second end of said first auxiliary frame element are located, such that said connection points at each end of the truss girder corresponding to where the first end of said first auxiliary frame element and the first end of said second auxiliary frame element are connected to an intermediate part of the first main structural frame element, the second end of said second auxiliary frame element and the first end of said third auxiliary frame element are connected to an intermediate part of the second main structural frame element, and the second end of said third auxiliary frame element and the second end of said first auxiliary frame element are connected to an intermediate part of the third main structural element.

9. The reinforcement structure according to claim 8, further comprising:

another auxiliary structural frame positioned within each main structural frame, each said another auxiliary structural frame including fourth and fifth auxiliary structural frame elements having (i) respective first ends thereof connected to a corresponding said first auxiliary structural frame element, and (ii) respective second ends thereof connected to an intermediate part of said fourth main structural frame element such that each said another auxiliary structural frame is triangular in shape.

* * * * *

UNITED STATES PATENT AND TRADEMARK OFFICE

CERTIFICATE OF CORRECTION

PATENT NO. : 6,892,410 B2
DATED : May 17, 2005
INVENTOR(S) : Mitsuhiro Tokuno et al.

It is certified that error appears in the above-identified patent and that said Letters Patent is hereby corrected as shown below:

Title page,
Item [73], Assignee, please add:

-- Asahi Engineering Co., Ltd.
3-9-6, Mitsukuchishinmachi, Kanazawa-shi
Ishikawa-ken, Japan

Eco Japan Co., Ltd.
5-201, Horiuchimachi, Nonoichi-machi, Ishikawa-gun
Ishikawa-ken, Japan

SE Corporation
1-3-6, Nishikanda, Chiyoda-ku
Tokyo, Japan --.

Signed and Sealed this

First Day of November, 2005

JON W. DUDAS
*Director of the United States Patent and Trademark Office*